United States Patent [19]

Steele, Jr. et al.

[11] Patent Number: 4,591,395

[45] Date of Patent: May 27, 1986

[54] METHOD OF HEAT TREATING LOW CARBON STEEL STRIP

[75] Inventors: James H. Steele, Jr., Carlisle; Alan J. Heckler; James W. Flowers, Jr., both of Middletown; George S. Powley, Carlisle, all of Ohio

[73] Assignee: Armco Inc., Middletown, Ohio

[21] Appl. No.: 684,968

[22] Filed: Dec. 20, 1984

Related U.S. Application Data

[62] Division of Ser. No. 491,867, May 5, 1983, abandoned.

[51] Int. Cl.[4] ..... C21D 9/46

[52] U.S. Cl. ..... 148/12 D; 148/12.3; 428/653

[58] Field of Search ..... 148/12 C, 12 D, 12 F, 148/36, 12.3; 75/125; 428/653

[56] References Cited

U.S. PATENT DOCUMENTS

| | | | |
|---|---|---|---|
| 2,597,979 | 5/1952 | Darmara | 148/12 C |
| 3,336,166 | 8/1967 | Shimzu et al. | 148/12.3 |
| 3,857,740 | 12/1974 | Gondo et al. | 148/12.3 |
| 3,879,232 | 4/1975 | Gondo et al. | 148/12 C |
| 4,043,807 | 8/1977 | Kirman | 75/125 |
| 4,067,754 | 1/1978 | Elias et al. | 148/12 F |
| 4,185,998 | 1/1980 | Reisdorf | 75/125 |
| 4,448,614 | 5/1984 | Morimoto et al. | 148/12.3 |

FOREIGN PATENT DOCUMENTS

| | | | |
|---|---|---|---|
| 1433825 | 12/1970 | Fed. Rep. of Germany | 148/12 C |
| 2311096 | 12/1976 | France | 148/12 C |
| 23229 | 3/1981 | Japan | 148/12 C |
| 90964 | 7/1981 | Japan | 148/12 D |
| 136927 | 10/1981 | Japan | 148/12 F |
| 13124 | 1/1982 | Japan | 148/12 C |
| 19332 | 2/1982 | Japan | 148/12 C |
| 19334 | 2/1982 | Japan | 148/12 D |
| 19335 | 2/1982 | Japan | 148/12 F |
| 19333 | 2/1982 | Japan | 148/12 C |
| 73125 | 5/1982 | Japan | 148/12 D |
| 668793 | 3/1952 | United Kingdom | 148/12 C |

*Primary Examiner*—Wayland Stallard

*Attorney, Agent, or Firm*—Frost & Jacobs

[57] ABSTRACT

A method of heat treating cold reduced, aluminum-killed low carbon steel strip containing up to 0.1% carbon, at least about 0.015% acid soluble aluminum, and manganese at least 10 times the sulfur content, comprising hot rolling, coiling at less than 1200° F., cold rolling to strip, and pretreating by heating at a temperature and for a time sufficient to precipitate aluminum nitride before substantial recrystallization occurs, thereby retarding recrystallization during subsequent heating.

11 Claims, No Drawings

METHOD OF HEAT TREATING LOW CARBON STEEL STRIP

This application is a division of application Ser. No. 491,867, filed May 5, 1983, now abandoned.

BACKGROUND OF THE INVENTION

This invention relates to a method of heat treating cold reduced, aluminum-killed low carbon steel strip, and more particularly to a pretreatment of the cold reduced strip within a critical temperature range prior to a continous anneal. By variation in the pretreatment conditions and in composition of the steel, the pretreatment step of this invention results either in attainment of high $r_m$ value or a high yield strength.

An article by R. H. Goodenow, *Transactions Of The ASM,* Vol. 59, pages 804–823, 1966, discusses the effect of aluminum nitride precipitates on recrystallization and grain structure of low carbon steels. Test data show that an increase in the aluminum nitride content inhibits recrystallization, and that cold working increases the rate of precipitation of aluminum nitride and inhibits the recrystallization process. Isothermal recrystallization curves are presented (p. 806), showing that annealing above 1100° F. required somewhat longer time to recrystallize completely in the case of an aluminum-killed steel containing 0.041% acid soluble aluminum and 0.0007% nitrogen as aluminum nitride. At 1050° F. the recrystallization curve departed from "the normal sigmoidal-shaped curve". At 1000° F. recrystallization stopped after 83% had recrystallized in a time interval up to 48 hours. Below 975° F. no recrystallization occurred up to 48 hours. The inhibiting effect of aluminum nitride on recrystallization in aluminum-killed steel was examined in a two-stage isothermal anneal comprising a heat treatment below 975° F. followed by heating up to 1300° F. Recrystallization occurred at 1300° F., but the time to start and completion of recrystallization increased with increasing aluminum nitride content. Similar results were obtained with initial heat treatments at 900° and 850° F. It was further observed that low temperature heat treatment, which promotes aluminum nitride precipitation in a time-dependent manner, causes a change in the recrystallized texture, mainly " . . . an increase in the relative intensity of the (111) component" (page 821).

No application of the findings of the article is suggested which would indicate possible benefits in obtaining higher strength, or better drawability with a continuous anneal.

Japanese No. 57073-125, published May 7, 1982, discloses subjecting a steel containing up to 0.15% carbon, up to 0.6% silicon, 0.5% to 1.6% manganese, 0.01% to 0.10% acid soluble aluminum, 0.04% to 0.80% chromium, 0.0005% to 0.003% boron and/or 0.02% to 0.4% vanadium, and balance iron, to hot rolling, coiling at 200° to 620° C., cold reducing by at least 40%, box annealing at 400° C. to the $A_1$ point, and then continuously hot dip zinc coating. It is alleged that the manganese content produces "improved delayed ageing property and paint-baking hardenability". The box annealing step before zinc coating is stated to enhance the $r_m$ value.

The effect of columbium and/or zirconium in retarding recrystallization is disclosed in U.S. Pat. Nos. 3,761,324; 3,963,531 and 4,067,754. No. 4,067,754 discloses annealing of a cold reduced low carbon strip at a temperature of about 1100° to 1300° F. for about 7 minutes to 24 hours, with the time inversely proportional to the temperature, whereby to recover ductility but not recrystallize and to achieve a yield strength of at least 90 ksi and an elongation of greater than 10%. If batch annealed at 1200° to 1400° F. (with a minimum of 4 hours at 1200° F.) or continuously annealed at 1500° to 1700° F. a fully recrystallized structure is obtained having a yield strength of 45 to 65 ksi and an elongation greater than 25%.

SUMMARY OF THE INVENTION

It is an object of the invention to provide a method of heat treating a cold reduced, aluminum-killed low carbon steel strip containing at least about 0.015% acid soluble aluminum, which by variation in the temperature range of a heat treatment after cold reduction permits attainment either of improved $r_m$ value and hence drawability, or a high yield strength.

According to the invention there is provided a method of heat treating cold reduced, aluminum killed low carbon steel strip, which comprises providing a steel containing up to about 0.1% carbon, at least about 0.015% acid soluble aluminum, and manganese at least 10 times the sulfur content, hot rolling said steel, coiling the hot rolled steel at a temperature less than 1200° F., cold rolling to strip thickness, and pretreating by heating said cold rolled strip to a temperature and for a time sufficient to precipitate aluminum nitride before substantial recrystallization of said steel occurs, whereby to retard recrystallization during subsequent heating of said strip at a higher temperature.

In one embodiment of the invention for obtaining strip having high $r_m$ value, the method comprises providing a steel containing up to about 0.1% carbon, at least about 0.015% acid soluble aluminum, and manganese at least 10 times the sulfur content, hot rolling said steel, coiling the hot rolled steel at a temperature less than 1200° F., cold rolling to strip thickness with a reduction in thickness of greater than 30%, pretreating by heating said cold rolled strip to a temperature and for a time sufficient to precipitate aluminum nitride before substantial recrystallization occurs, and continuously annealing said pretreated strip at a temperature greater than about 1350° F., whereby to recrystallize said steel.

In another embodiment of the invention for obtaining strip having high yield strength, the method comprises providing a steel containing up to about 0.1% carbon, at least about 0.015% acid soluble aluminum, and manganese at least 10 times the sulfur content, hot rolling said steel, coiling the hot rolled steel at a temperature less than 1200° F., cold rolling to strip thickness, pretreating by heating said cold rolled strip at a temperature and for a time sufficient to precipitate aluminum nitride in an amount sufficient to prevent substantial recrystallization during subsequent continuous annealing of said pretreated strip at a temperature less than 1350° F.

The invention further provides a hot-dip aluminum coated, cold reduced low carbon steel strip having a yield strength of at least 80 ksi, the steel consisting essentially of up to 0.1% carbon, at least about 0.015% acid soluble aluminum, manganese at least about 10 times the sulfur content, and balance essentially iron.

Hot-dip metallic coated, cold reduced low carbon steel strip having high $r_m$ value can also be produced in accordance with the method of the present invention.

DETAILED DESCRIPTION

As is well known in the art, the term $r_m$ value is used to designate average plastic strain ratio and is calculated as:

$$r_m = \frac{1}{4}[r(\text{longitudinal}) + r(\text{transverse}) + 2r(\text{diagonal})]$$

In both the above described embodiments of the method of the invention, it is necessary that the hot rolled steel be coiled at a temperature less than 1200° F. The broad temperature range of the pretreatment is from about 700° to about 1100° F.

In the embodiment which results in cold reduced strip having high $r_m$ value, the amount of cold reduction should be greater than 30% and preferably is greater than 50%. The pretreatment is preferably conducted within the range of about 900° to about 1000° F. and may be a box anneal of the tight coil annealing type or the open coil annealing type. The time of the pretreatment anneal must be of sufficient length to cause aluminum nitride precipitation in an amount sufficient to retard recrystallization and is preferably at least about 6 hours in duration. While recrystallization may occur during the pretreatment and give good $r_m$ values, it is preferred that the strip be unrecrystallized and hard prior to continuous annealing to prevent damage to the strip during subsequent processing, i.e. coil breaks, scratches, dents, etc. If the pretreatment temperature is greater than 1000° F. and recrystallization would occur at the pretreatment temperature, the heating rate should be slow through the 700° to 1000° F. range in order to precipitate aluminum nitride before recrystallization occurs, e.g. about 50 Fahrenheit degrees per hour.

In this embodiment the pretreatment step is followed by a continuous anneal at a temperature greater than 1350° F. but not above the $A_3$ point, thereby recrystallizing the steel.

For high $r_m$ value strip the steel should contain up to about 0.1% carbon, manganese in an amount at least 10 times the sulfur content, at least 0.015% acid soluble aluminum, residual sulfur and phosphorus, and balance essentially iron. Preferably, such a steel contains less than about 0.05% carbon, about 0.20% to about 0.35% manganese, about 0.02% to about 0.05% acid soluble aluminum, and at least 0.002% nitrogen.

In this embodiment the hot rolled steel is preferably coiled at a temperature of about 1000° to about 1050° F. Preferably the continuous anneal after pretreatment is conducted at a temperature of about 1500° to about 1575° F.

In the embodiment resulting in strip having a high yield strength, the pretreatment preferably comprises heating at a temperature within the range of about 750° to about 950° F., and more preferably about 750° to about 875° F., for a time of sufficient magnitude to allow precipitation of aluminum nitride in an amount sufficient to retard recrystallization. Preferably the length of this anneal is at least about 6 hours. Thereafter, the continuous anneal is conducted at a preferred temperature range of about 1225° to about 1300° F.

For strip having high yield strength, preferably at least 80 ksi, manganese is present in an amount at least 10 times the sulfur content, copper may be present in an amount up to 1.2%, sulfur and phosphorus are in residual amounts, and the balance is essentially iron. Such a steel preferably contains about 0.02% to about 0.05% carbon, about 0.8% to 1.2% copper or about 0.8% to about 1.0% manganese, about 0.05% to about 0.08% acid soluble aluminum, and at least 0.002% nitrogen.

Any one or more of the preferred ranges indicated above can be used with any one or more of the broad ranges for the remaining elements set forth above.

It is an important advantage of the present method that it can be incorporated as part of a so-called in-line anneal hot dip metallic coating process. Such a process utilizes furnace processing for surface preparation with simultaneous heat treatment. Exemplary processes include, but are not limited to, the Sendzimir and the Armco-Selas processes. Heating to remove residual cold rolling mill oil is followed by heating in a hydrogen-containing atmosphere capable of reducing surface oxide. This step may be the continuous annealing step in the method of the present invention. This is followed by bringing the strip temperature approximately to that of a bath of molten coating metal, passing the strip through the molten coating metal bath, removing excess coating metal from the strip and solidifying the coating metal remaining on the strip.

Since low carbon steels ordinarily recrystallize at about 1000° to about 1050° F., and since hot dip aluminum coating metal baths are maintained at a temperature of about 1250° to 1300° F., it is evident that recrystallization cannot be avoided in conventional processing. However, the retarded recrystallization achieved in the practice of the present invention permits production of a coated strip having a preferred yield strength of at least 80 ksi.

While the process of the invention thus has particular utility for so-called in-line anneal hot dip metallic coating processes, it will be recognized that the strip can be coated by continuous processes of the so-called out-of-line anneal or preanneal type without adversely affecting the mechanical properties. Such processes include hot dip coating in molten metal, and electroplating wherein the preliminary coating line treatment is usually wet chemical cleaning. Preanneal dip coating processes may then incorporate either strip fluxing or strip heating in a hydrogen-inert gas atmosphere prior to coating and involve a maximum in-line strip temperature approximately equal to molten metal bath temperature. Metals which may be used for either of the above types of coating include aluminum, zinc, alloys of aluminum, or alloys or zinc.

In a preferred embodiment which results in a yield strength of greater than 80 ksi, the addition of at least about 0.8% manganese may tend to minimize the effect of variable aluminum contents on recrystallization temperature and thereby prevent recrystallization from occurring during the continuous anneal of the pretreated strip.

In another embodiment copper may be used in the high strength embodiment of the present process in order to confer additional retardation of the recrystallization. For this purpose, about 1% copper is desired. Copper may additionally increase the yield strength by precipitation hardening and/or solid solution strengthening.

Although not intending to be bound by theory, it is believed that the influence of the pretreatment step of the method of the present invention on the higher recrystallization temperature and improved $r_m$ value is due to the precipitation or clustering of aluminum nitride particles at grain boundaries during recovery and prior to recrystallization. The aluminum content affects the optimum pretreatment temperature in retarding recrystallization. Thus, a relatively high aluminum level of about 0.06% responds to a lower and wider pretreatment temperature range (about 700° to about 930° F.) than does a relatively low aluminum level of about 0.03% (about 850° to about 930° F.).

Another unexpected feature is the formation of elongated grains after continuous annealing. Under normal conditions an aluminum-killed steel is equiaxed after continuous annealing, and the $r_m$ value is relatively low. The unusual appearance of elongated grains in the method of the present invention after continuous annealing is attributed to the afore-mentioned precipitation or clustering of aluminum nitride particles in the cold rolled grain boundaries and/or recovered subgrain boundaries during pretreatment which inhibits grain growth.

Numerous trials have been conducted to determine the effect of thermal pretreatment on the recrystallization response of aluminum-killed steel during subsequent hot dip coating operations. Since hot dip aluminum coating involves the highest metal bath temperature encountered in continuous coating lines and since an aluminum coated product having high $r_m$ value or a yield strength of at least 80 ksi has particular utility, substantially all the trials were aluminum coating operations. It will of course be understood that coating with zinc or zinc alloys can involve substantially lower peak metal temperatures, and hence would impose much less stringent requirements which could be met automatically if the requirements for aluminum coating could be met.

A number of heats of varying aluminum content were prepared, by hot rolling, coiling at a temperature less than 1200° F., cold rolling to strip thicknesses ranging from about 0.02 inch to about 0.05 inch, and pretreating at temperatures ranging from 700° to 965° F. The experimental coils were then subjected to coating under two different conditions, one involving a low temperature cycle wherein the peak metal temperature ranged between 1250° and 1300° F. and the other a high temperature cycle wherein the peak metal temperature ranged between 1500° and 1550° F.

The compositions of this series of trials are set forth in Table I, and mechanical properties before and after coating at low and high temperature cycles are set forth in Table II. The amount of nitrogen present as aluminum nitride after pretreatment at various temperatures is set forth in Table III. In Table IV microstructures of two samples (one containing 0.034% aluminum and the other containing 0.060% aluminum) are tabulated.

All pretreatment anneals in the data of Table II were of 12 hours duration with a heat up and cool down rate of 50 Fahrenheit degrees per hour.

The purpose of the low temperature cycle at 1250° to 1300° F. was to produce a high strength grade having a yield strength of at least 80 ksi, while the purpose of the high temperature cycle at 1500° to 1550° F. was to achieve a coated product with high $r_m$ value after continuous annealing.

Referring to Table II it is apparent from the mechanical properties that all materials responded to the pretreatment anneal conducted within the range of 700° to 930° F. Yield strength and tensile strength decreased slightly, and elongation increased in comparison to the properties in the cold rolled condition. After pretreatment at 965° F., a drastic change in mechanical properties occurred, indicating that the recrystallization temperature had been exceeded. Mechanical properties obtained after coating in the low temperature range confirmed not only that the pretreatment was successful in retarding recrystallization but also demonstrated it to be possible to produce a minimum yield strength of 80 ksi for aluminum-killed, aluminum coated steel strip. Four of the five materials of Tables I and II had yield strengths above 80 ksi in at least one pretreatment condition. It is noted that sample 5 had a thickness of 0.029 inch whereas the next thinnest sample had a thickness of 0.035 inch. It is believed that sample 5 reached a higher but unknown temperature on the coating line which resulted in complete recrystallization.

Table II also indicates that yield strength is dependent upon composition as well as pretreatment temperature. Comparison of samples 1 and 2 with samples 3 and 4, with aluminum ranges of 0.028–0.038% and 0.060–0.063%, respectively, showed two trends. First, a higher pretreatment temperature was necessary to produce maximum yield strength after coating with the low aluminum samples than with the high aluminum samples. Secondly, the high aluminum samples developed a yield strength greater than 80 ksi over a wider pretreatment temperature range than the lower aluminum samples. More specifically, a pretreatment temperature of 930° F. produced maximum yield strength in the low aluminum samples compared to the pretreatment temperature of 850° F. for the high aluminum samples. A pretreatment temperature range of 700° to 930° F. was effective for the high aluminum samples, whereas a range of 850° to 930° F. was effective for the low aluminum samples.

The high temperature cycle data of Table II show that $r_m$ value can be increased on continuous coating lines by the thermal pretreatment of the method of the present invention. Higher pretreatment temperature produced higher $r_m$ values for samples coated using a peak metal temperature range of 1500° to 1550° F. Highest $r_m$ values were produced in the low aluminum samples, contrary to the effect noted above with respect to yield strength. Without pretreatment the $r_m$ values ranged between 1.03 and 1.17, whereas after pretreatments at 930° and 965° F. the $r_m$ values of the low aluminum samples were 1.44–1.73 and 1.79–1.92, while the high aluminum samples were 1.08–1.16 and 1.23–1.83. In all instances the highest $r_m$ value was produced when the steel was completely recrystallized before coating. The amount of cold reduction varied from 61 to 71% in the samples and may account for some of the variation in $r_m$ values.

Table III shows that aluminum nitride precipitates are detected following pretreatment at least in some samples. However, the method used to detect aluminum nitride has a lower limit due to the size of the precipitates. The Table therefore suggests that aluminum nitride is precipitated, but the amount and size of the precipitates required to retard recrystallization was not determined. Aluminum nitride was detected in some pretreated samples which resulted in high yield strength after continuous annealing. Based on the nitrogen analysis, it is concluded that extremely small particles of aluminum nitride or clusters of aluminum and nitrogen atoms, which were undetected by the analytical method used, were responsible for retarding recrystallization. As the particles became larger and hence detectable, their effectiveness in retarding recrystallization was decreased and yield strength dropped.

Turning next to Table IV, samples 1 to 3 were chosen as representative of low and high aluminum contents, respectively. Comparison of mechanical properties in Table II with the microstructures of Table IV indicates that those samples which had yield strengths above 80 ksi also exhibited an unrecrystallized grain structure. As the percent recrystallization increased, a corresponding drop in yield strength occurred. Samples coated using the high temperature cycle had elongated grains in some instances. In aluminum-killed steels elongated grains are associated with the development of high $r_m$ values and are attributed to aluminum nitride particles precipitated or clustered in the cold rolled or recovered grain boundaries during annealing, which inhibit grain growth. Since the thermal pretreatment permitted or caused aluminum nitride to precipitate, some grains with 2:1 elongation were produced.

Another series of trials was conducted on a laboratory coating line for aluminum-killed steels. Compositions are shown in Table V and $r_m$ values in Table VI as a function of various pretreatment temperatures, soak times and continuous annealing cycles.

Trials were also conducted to determine the effect of copper and manganese additions on strength when using a thermal pretreatment prior to aluminum coating. The compositions of experimental steels containing varying levels of copper and manganese are set forth in Table VII. Mechanical properties of copper-containing alloys after aluminum coating are set forth in Table VIII, while mechanical properties of manganese-containing alloys after aluminum coating are set forth in Table IX.

Preliminary screening tests, not reported herein, showed that steels containing up to about 0.25% copper showed no resistance to recrystallization other than that caused by aluminum nitride, despite thermal pretreatment. Similarly, steels containing up to about 0.40% manganese showed no retardation in recrystallization above that caused by aluminum nitride, despite thermal pretreatment. On the other hand, copper at about 0.9% or manganese at about 1% showed strong retardation of recrystallization. At about 0.7% manganese some retardation was exhibited after a one minute anneal at 1200° F.

Referring to Table VIII, it is evident that copper levels of 0.81% and 0.89% responded strongly to most of the pretreatment conditions, and it is postulated that the combined effects from retarded recrystallization and precipitation hardening contributed to the high yield strengths, which in some cases exceeded 100 ksi. However, samples with 0.61% copper or less did not achieve a yield strength of 80 ksi under any pretreatment conditions. The optimum pretreatment appears to be at 925° F. for 12 hours.

Referring to Table IX, it is apparent that steels containing about 1% manganese exceeded 80 ksi yield strength for all pretreatment conditions, but the optimum thermal pretreatment was 925° F. for 12 hours, which showed some response for manganese at about 0.75%, as well as at the 1% level.

These data thus demonstrate that high copper and high manganese additions can raise aluminum-killed, aluminum coated steel strip to a yield strength of at least 80 ksi. From the standpoint of ductility, it is pointed out that elongation values of at least 4% were obtained for the copper-containing steels even when the yield strength was about 110 ksi. Elongation values were somewhat higher for manganese-containing steels, and such ductility is adequate for the limited forming operations to which a high strength aluminum coated product would be subjected.

TABLE I

| | Compositions - Weight Percent | | | | | | | | |
|---|---|---|---|---|---|---|---|---|---|
| | Gage | | | | | | | | |
| Sample | inches | mm | C | Mn | Si | P | S | Al | N |
| 1 | .035 | .89 | .045 | .33 | .005 | .007 | .008 | .034 | .0084 |
| 2 | .043 | 1.09 | .040 | .30 | .014 | .009 | .010 | .038 | .0059 |
| 3 | .039 | .99 | .039 | .28 | .012 | .008 | .010 | .060 | .0070 |
| 4 | .046 | 1.17 | .047 | .34 | <.004 | .006 | .012 | .063 | .0050 |
| 5 | .029 | .74 | .035 | .35 | .008 | .009 | .009 | .067 | .0050 |

TABLE II

Mechanical Properties Before and After Coating at High and Low Temperature Cycle

| | | | | | | Pretreatment Temperature | | | | | | | | | |
|---|---|---|---|---|---|---|---|---|---|---|---|---|---|---|---|
| | | | | | | 700 F./371 C. | | | | | 850 F./454 C. | | | | |
| Sample | Coating Cycle | As Cold Rolled YS | UTS | % El | HRB | $r_m$ | YS | UTS | % El | HRB | $r_m$ | YS | UTS | % El | HRB | $r_m$ |
| 1 | Before Coating | 109.2 | 109.2 | — | 100 | | 102.0 | 102.6 | 9.2 | 99.8 | | 97.4 | 99.2 | 12.0 | 99.0 | |
| | Low Cycle | 45.8 | 56.0 | 34.8 | 60.5 | | 46.1 | 56.3 | 31.5 | 56.8 | | 76.7 | 82.6 | 13.5 | 85.0 | |
| | High Cycle | 41.8 | 48.4 | 39.5 | 60.0 | 1.14 | 46.0 | 52.1 | 36.2 | 64.5 | 1.18 | 44.8 | 51.8 | 29.8 | 65.0 | 1.29 |
| 2 | Before Coating | 99.2 | 99.2 | — | 96.8 | | 91.6 | 93.1 | 10.0 | 96.5 | | 85.8 | 88.7 | 11.5 | 94.5 | |
| | Low Cycle | 52.4 | 60.2 | 20.8 | 77.2 | | 46.2 | 55.6 | 28.0 | 77.8 | | 76.8 | 81.4 | 13.8 | 91.8 | |
| | High Cycle | 41.3 | 49.0 | 34.8 | 62.0 | 1.17 | 39.6 | 48.9 | 38.0 | 55.5 | 1.12 | 40.4 | 48.2 | 33.8 | 55.2 | 1.33 |
| 3 | Before Coating | 106.6 | 106.6 | 2.0 | 97.8 | | 98.0 | 99.0 | 9.0 | 97.8 | | 93.9 | 95.6 | 11.5 | 97.8 | |
| | Low Cycle | 55.8 | 64.0 | 18.2 | 86.0 | | 85.2 | 88.1 | 13.0 | 93.0 | | 90.0 | 92.9 | 14.0 | 96.8 | |
| | High Cycle | 41.8 | 49.0 | 38.0 | 58 | 1.03 | 41.8 | 49.4 | 35.8 | 55.0 | 1.16 | 40.7 | 48.8 | 35.0 | 56.0 | 1.30 |
| 4 | Before Coating | 99.2 | 99.2 | — | 98.2 | | 93.9 | 96.0 | 10.5 | 98.0 | | 89.4 | 92.2 | 12.0 | 97.8 | |
| | Low Cycle | 55.3 | 63.0 | 22.5 | 76.2 | | 83.1 | 86.8 | 12.8 | 92.5 | | 89.6 | 93.2 | 12.2 | 96.2 | |
| | High Cycle | 41.3 | 49.5 | 37.5 | 61.0 | 1.15 | 46.6 | 54.9 | 34.2 | 68.5 | 1.10 | 47.7 | 55.2 | 36.5 | 69.0 | 1.06 |
| 5 | Before Coating | 109.6 | 109.6 | 2.0 | 98.2 | | | | | | | 98.8 | 100.0 | 9.0 | 96.0 | |
| | Low Cycle | 46.9 | 53.6 | 34.2 | 62.8 | | | | | | | 40.6 | 50.6 | 37.8 | 59.8 | 1.47 |
| | High Cycle | 42.3 | 49.4 | 38.5 | 62.5 | | | | | | | 39.1 | 48.3 | 36.5 | 58.0 | 1.56 |

| | | Preteatment Temperature | | | | | | | | | |
|---|---|---|---|---|---|---|---|---|---|---|---|
| | | 930 F./499 C. | | | | | 965 F./518 C. | | | | |
| Sample | Coating Cycle | YS | UTS | % El | HRB | $r_m$ | YS | UTS | % El | HRB | $r_m$ |
| 1 | Before Coating | 96.0 | 97.4 | 11.2 | 98.0 | | 56.1 | 68.0 | 19.2 | 77.0 | |
| | Low Cycle | 90.6 | 92.6 | 12.0 | 96.8 | | 46.8 | 60.0 | 21.2 | 72.8 | |
| | High Cycle | 44.8 | 52.1 | 31.8 | 62.2 | 1.73 | 40.8 | 50.1 | 33.5 | 59.5 | 1.92 |
| 2 | Before Coating | 84.9 | 87.8 | 12.0 | 94.8 | | 40.8 | 53.2 | 32.5 | 56.5 | |
| | Low Cycle | 80.9 | 84.9 | 13.2 | 92.2 | | 41.6 | 54.8 | 30.0 | 63.2 | |
| | High Cycle | 38.3 | 47.6 | 38.2 | 55.8 | 1.44 | 35.4 | 46.8 | 38.8 | 55.5 | 1.79 |

TABLE II-continued

| Mechanical Properties Before and After Coating at High and Low Temperature Cycle | | | | | | | | | | | |
|---|---|---|---|---|---|---|---|---|---|---|---|
| 3 | Before Coating | 90.8 | 93.1 | 11.8 | 96.2 | | 39.9 | 52.6 | 35.8 | 56.0 | |
| | Low Cycle | 86.2 | 89.6 | 13.6 | 95.8 | | 42.8 | 53.8 | 32.0 | 60.2 | |
| | High Cycle | 41.6 | 49.4 | 38.2 | 60.5 | 1.16 | 35.2 | 47.6 | 36.0 | 55.0 | 1.83 |
| 4 | Before Coating | 84.6 | 90.2 | 12.2 | 96.0 | | 35.2 | 49.6 | 39.8 | 53.0 | |
| | Low Cycle | 78.8 | 83.4 | 13.5 | 92.0 | | 38.1 | 51.9 | 34.8 | 58.8 | |
| | High Cycle | 42.2 | 50.3 | — | 62.2 | 1.08 | 40.0 | 50.2 | 40.0 | 58.5 | 1.23 |
| 5 | Before Coating | 90.0 | 92.5 | 11.8 | 91.8 | | | | | | |
| | Low Cycle* | 40.2 | 51.4 | 36.2 | 60.5 | 1.60 | | | | | |
| | High Cycle* | 36.8 | 46.6 | 36.0 | 55.5 | 1.52 | | | | | |

Low Cycle = 1250–1300° F. (677–704° C.) peak metal temperature
High Cycle = 1500–1550 F. (816–843 C.) peak metal temperature
Samples 1–4 coiled at 1100 F.
Samples 5 coiled at 1150 F.
Pretreat heating rate 50 F./hr., 12 hr. soak
*Sample reached a higher but unknown temperature in the coating line which resulted in complete recrystallization in the continuous anneal.

TABLE III

| | | % Nitrogen as AlN | | | |
|---|---|---|---|---|---|
| | | Pretreatment | | | |
| Sample | As Cold Rolled | 700 F./371 C. | 850 F./454 C. | 930 F./499 C. | 965 F./518 C. |
| 1 | N.D. | N.D. | N.D | N.D. | .0037 |
| 2 | N.D. | N.D. | N.D | N.D. | .0026 |
| 3 | N.D. | N.D. | N.D | .0020 | .0035 |
| 4 | N.D. | N.D. | N.D | .0019 | .0024 |
| 5 | N.D. | | | .0020 | |

N.D. = Not Detected

TABLE V

| | Compositions - Weight Percent | | | | | | | |
|---|---|---|---|---|---|---|---|---|
| Code | C | S | N | O | Mn | Si | P | Al |
| 6 | .0060 | .0070 | .0067 | .0034 | .19 | .010 | .007 | .049 |
| 7 | .048 | .017 | .0051 | — | .37 | .011 | .005 | .060 |
| 8 | .038 | .0075 | .0079 | — | .32 | .017 | .008 | .042 |
| 9 | .035 | .012 | .0052 | — | .35 | .018 | .011 | .046 |
| 10 | .043 | .010 | .0082 | — | .33 | .013 | .009 | .058 |
| 11 | .037 | .0092 | .0081 | — | .33 | .012 | .010 | .046 |
| 12 | .037 | .010 | .0067 | — | .33 | .016 | .011 | .035 |

TABLE IV

| | | | Microstructure | | |
|---|---|---|---|---|---|
| Sample | % Al | Pretreatment | % Recrystallized | Grain Size | Elongation |
| | | | As Pretreated | | |
| 1 | .034 | as cold rolled | 0 | — | — |
| | | 700 F./371 C. | 0 | — | — |
| | | 850 F./454 C. | 0 | — | — |
| | | 930 F./499 C. | 0 | — | — |
| | | 965 F./518 C. | 80 | 8 | — |
| 3 | .060 | as cold rolled | 0 | — | — |
| | | 700 F./371 C. | 0 | — | — |
| | | 850 F./454 C. | 0 | — | — |
| | | 930 F./499 C. | 0 | — | — |
| | | 965 F./518 C. | 100 | 8 | 2:1 |
| | | | Low Coating Cycle | | |
| 1 | .034 | as cold rolled | 100 | 11 | equiaxed |
| | | 700 F./371 C. | 100 | 10 | equiaxed |
| | | 850 F./454 C. | 40 | 10½ | some 2:1 |
| | | 930 F./499 C. | 0 | — | — |
| | | 965 F./518 C. | 100 | 8 | 2:1 |
| 3 | .060 | as cold rolled | 80 | 10–11 | equiaxed |
| | | 700 F./371 C. | 0 | — | — |
| | | 850 F./454 C. | 0 | — | — |
| | | 930 F./499 C. | 0 | — | — |
| | | 965 F./518 C. | 90 | 8–9 | 2:1 |
| | | | High Coating Cycle | | |
| 1 | .034 | as cold rolled | 100 | 9 | equiaxed |
| | | 700 F./371 C. | 100 | 9 | equiaxed |
| | | 850 F./454 C. | 100 | 8 | equiaxed |
| | | 930 F./499 C. | 100 | 7–8 | 2:1 |
| | | 965 F./518 C. | 100 | 8 | 2:1 |
| 3 | .060 | as cold rolled | 100 | 8–9 | equiaxed |
| | | 700 F./371 C. | 100 | 7 | equiaxed |
| | | 850 F./454 C. | 100 | 6–7 | equiaxed |
| | | 930 F./499 C. | 100 | 7–8 | equiaxed |
| | | 965 F./518 C. | 100 | 7–8 | some 2:1 |

TABLE VI

| | | $r_m$ Values | | | | | | |
|---|---|---|---|---|---|---|---|---|
| | | Pretreatment | | | | | | |
| Continuous Anneal Cycle | Sample # | None | 870 F. 0 hrs. | 925 F. 6 hrs. | 925 F. 12 hrs. | 1000 F. 6 hrs. | 1000 F. 12 hrs. | 1090 F. 12 hrs. |
| 1 | 6 | — | 1.26 | 1.54 | 1.16 | .94 | 1.59 | 1.52 |
| 2 | 6 | 1.25 | 1.63 | 1.54 | 1.57 | 1.49 | 1.76 | 1.82 |

TABLE VI-continued

| Continuous Anneal Cycle | Sample # | $r_m$ Values Pretreatment None | 870 F. 0 hrs. | 925 F. 6 hrs. | 925 F. 12 hrs. | 1000 F. 6 hrs. | 1000 F. 12 hrs. | 1090 F. 12 hrs. |
|---|---|---|---|---|---|---|---|---|
| 1 | 7 | — | 1.21 | 1.39 | 1.37 | 1.31 | 1.56 | 1.50 |
| 2 | 7 | 1.00 | 1.43 | 1.30 | 1.26 | 1.51 | 1.60 | 1.43 |
| 1 | 8 | — | 1.10 | 1.30 | 1.30 | 1.64 | 1.49 | 1.53 |
| 2 | 8 | 0.99 | 1.13 | 1.31 | — | 1.31 | 1.51 | 1.47 |
| 1 | 9 | — | .99 | 1.08 | 1.21 | 1.49 | 1.54 | 1.40 |
| 2 | 9 | 1.06 | 1.14 | 1.14 | 1.17 | 1.44 | 1.44 | 1.46 |
| 1 | 10 | — | 1.11 | 1.30 | 1.48 | 1.64 | 1.41 | 1.32 |
| 2 | 10 | 1.04 | 1.54 | 1.43 | 1.48 | 1.58 | 1.65 | 1.57 |
| 1 | 11 | — | 1.01 | 1.34 | 1.31 | 1.59 | 1.50 | 1.57 |
| 2 | 11 | .99 | 1.16 | 1.41 | 1.35 | 1.68 | 1.32 | — |
| 1 | 12 | — | 1.03 | 1.01 | 1.19 | 1.47 | 1.53 | 1.52 |
| 2 | 12 | 1.08 | 1.27 | 1.30 | 1.25 | 1.43 | 1.68 | 1.45 |

1 = 1400 F.
2 = 1550 F.

TABLE VII

| Sample | Compositions - Weight Percent Final Cold Rolled Thickness .020" (0.51 mm) % Cu | % Mn | % s | % C | % Al | % N |
|---|---|---|---|---|---|---|
| 13 | .18 | .42 | .030 | .049 | .030 | .0036 |
| 14 | .41 | .29 | .032 | .039 | .028 | .0043 |
| 15 | .60 | .29 | .032 | .039 | .028 | .0043 |
| 16 | .81 | .29 | .032 | .039 | .028 | .0043 |
| 17 | .89 | .42 | .030 | .049 | .030 | .0036 |
| 18 | — | .39 | .034 | .047 | .024 | .0050 |
| 19 | — | .40 | .024 | .053 | .029 | .0072 |
| 20 | — | .42 | .030 | .047 | .030 | .0045 |
| 21 | — | .71 | .034 | .045 | .024 | .0050 |
| 22 | — | .75 | .024 | .053 | .029 | .0072 |
| 23 | — | 1.03 | .034 | .045 | .024 | .0050 |
| 24 | — | 1.09 | .024 | .053 | .029 | .0072 |

TABLE VIII

Tensile Properties of Copper Alloys After Processing Specimen Thickness .020" (0.51 mm)

| Pre-treatment | Sample | % Cu | Yield Strength (ksi) | Ultimate Tensile Strength (ksi) | % Elon-gation | Hard-ness $R_B$ |
|---|---|---|---|---|---|---|
| None | 14 | 0.41 | 44.5 | 52.8 | 22 | 65 |
| As Cold | | | 50.0 | 58.9 | 20 | 65 |
| Rolled | 15 | 0.60 | 49.7 | 56.4 | 25.5 | 62 |
| | | | 44.7 | 55.3 | 23.5 | 63 |
| | 16 | 0.81 | 50.5 | 60.9 | 22 | 69.5 |
| | | | 51.2 | 61.6 | 19 | 68 |
| 75 F. | 13 | 0.81 | 54.6 | 61.2 | 27.5 | 65 |
| (399 C.) | | | | | | |
| 12 hr. | | | 53.0 | 59.5 | 30 | 64 |
| | 14 | 0.41 | 52.7 | 60.5 | 26 | 60 |
| | | | 54.0 | 61.4 | 22 | 59 |
| | 15 | 0.60 | 56.6 | 63.5 | OG* | 68 |
| | | | 56.8 | 64.5 | 20 | 68 |
| | 16 | 0.81 | 65.5 | 74.8 | 14 | 79 |
| | | | 65.7 | 75.3 | 14 | 79.5 |
| | 17 | 0.89 | 112.2 | 112.5 | 6 | 83(?) |
| | | | 109.2 | 111.2 | OG* | 96 |
| 850 F. | 13 | 0.18 | 49.8 | 58.5 | 21 | 61 |
| (399 C.) | | | | | | |
| 12 hr. | | | 49.3 | 58.0 | 22.5 | 62 |
| | 14 | 0.41 | 51.7 | 60.8 | 20 | 61 |
| | | | 50.9 | 59.9 | 20.5 | 61 |
| | | | 50.8 | 60.5 | 20 | 59 |
| | | | 50.2 | 59.7 | 20 | 58.5 |
| | 15 | 0.60 | 59.5 | 70.4 | 18 | 68 |
| | | | 61.5 | 72.8 | 15 | 65 |
| | | | 56.0 | 66.9 | OG* | 73 |
| | | | 55.1 | 65.9 | 15.5 | 71.5 |
| | 16 | 0.81 | 94.2 | 99.6 | OG* | 95 |
| | | | 105.6 | 107.1 | 6.5 | 96 |
| | | | 100.3 | 100.8 | 9 | 96 |
| | | | 107.6 | 108.1 | 5 | 96 |
| | 17 | 0.89 | 118.1 | 118.1 | 4 | 91 |

TABLE VIII-continued

Tensile Properties of Copper Alloys After Processing Specimen Thickness .020" (0.51 mm)

| Pre-treatment | Sample | % Cu | Yield Strength (ksi) | Ultimate Tensile Strength (ksi) | % Elon-gation | Hard-ness $R_B$ |
|---|---|---|---|---|---|---|
| | | | 118.1 | 118.1 | 4 | 97.5 |
| 950 F. | 13 | 0.18 | 50.7 | 60.4 | 22 | 66.5 |
| (510 C.) | | | | | | |
| 3 hr. | | | 60.0 | 68.9 | 20 | 74 |
| | 14 | 0.41 | 52.6 | 60.7 | 18 | 61 |
| | | | 52.1 | 60.2 | 22 | 61 |
| | | | 50.7 | 60.8 | 21 | 59 |
| | | | 49.6 | 60.3 | 20 | 60 |
| | 15 | 0.60 | 52.7 | 66.1 | 17 | 73 |
| | | | 54.2 | 61.1 | 19 | 72 |
| | | | 65.2 | 66.1 | OG* | 73.5 |
| | | | 56.4 | 71.0 | 11 | 75 |
| | 16 | 0.81 | 101.3 | 103.7 | 4 | 95 |
| | | | 97.5 | 100.8 | OG* | 95 |
| | | | 107.3 | 108.8 | 9 | 96 |
| | | | 106.3 | 107.7 | 5 | 96 |
| | 17 | 0.89 | 109.1 | 110.4 | 8 | 98 |
| | | | 111.4 | 111.9 | 4.5 | 98 |
| 925 F. | 13 | 0.18 | 55.1 | 63.6 | 19 | 63.5 |
| (495 C.) | | | | | | |
| 12 hr. | | | 52.4 | 61.5 | 22 | 69.5 |
| | 14 | 0.41 | 49.3 | 57.5 | 20 | 61 |
| | | | 53.1 | 61.3 | 23 | 62 |
| | | | 49.9 | 61.1 | 19 | 59 |
| | | | 49.9 | 58.2 | 20 | 59 |
| | 15 | 0.60 | 71.4 | 80.9 | 10 | 83 |
| | | | 61.3 | 71.7 | 11 | 83 |
| | | | 69.5 | 76.2 | OG* | 76 |
| | | | 68.7 | 78.6 | 11 | 83 |
| | 16 | 0.81 | 103.5 | 104.4 | 4 | 96 |
| | | | 103.0 | 103.9 | 5 | 95 |
| | | | 103.1 | 105.0 | 8 | 95.5 |
| | | | 101.7 | 103.6 | 8 | 95 |
| | 17 | 0.89 | 112.5 | 113.5 | 4 | 91 |
| | | | 113.8 | 113.8 | 6 | 91 |
| 1100 F. | 13 | 0.18 | 47.3 | 54.9 | 23 | 59 |
| (593 C.) | | | | | | |
| 10 min. | | | 50.3 | 58.2 | 24 | 61 |
| | 14 | 0.41 | 46.2 | 56.1 | 25 | 58 |
| | | | 44.5 | 55.3 | 23 | 58 |
| | | | 45.0 | 55.4 | 22 | 55 |
| | | | 43.8 | 53.7 | 18 | 55 |
| | 15 | 0.60 | 42.2 | 55.1 | 15 | 59 |
| | | | 44.4 | 57.5 | 22 | 61 |
| | | | 42.6 | 55.2 | 18 | 61.5 |
| | | | 44.1 | 57.3 | 18.5 | 61 |
| | 16 | 0.81 | 99.9 | 102.3 | 9 | 93 |
| | | | 63.0 | 75.3 | 14 | 78 |
| | | | 102.9 | 104.9 | 9.5 | 95 |
| | | | 103.9 | 105.4 | 10 | 95.5 |
| | 17 | 0.89 | 85.7 | 91.0 | OG* | 95.5 |

TABLE VIII-continued

Tensile Properties of Copper Alloys After Processing
Specimen Thickness .020" (0.51 mm)

| Pre-treatment | Sample | % Cu | Yield Strength (ksi) | Ultimate Tensile Strength (ksi) | % Elon-gation | Hard-ness $R_B$ |
|---|---|---|---|---|---|---|
| | | | 100.8 | 104.2 | 4 | 95 |

*Specimen broke out of gage length

TABLE IX

Tensile Properties of Copper Alloys After Processing
Specimen Thickness .020" (0.51 mm)

| Pre-treatment | Sample | % Mn | Yield Strength (ksi) | Ultimate Tensile Strength (ksi) | % Elon-gation | Hard-ness $R_B$ |
|---|---|---|---|---|---|---|
| 750 F. (399 C.) 12 hr. | 18 | 0.39 | 50.1 | 55.9 | 29 | 62 |
| | | | 50.7 | 55.6 | 28 | 63 |
| | 19 | 0.40 | 51.7 | 59.5 | 24 | 63.5 |
| | | | 50.8 | 57.5 | 22 | 63 |
| | 20 | 0.42 | 50.0 | 57.1 | 24 | 61.5 |
| | | | 50.9 | 57.2 | 23 | 62 |
| | 21 | 0.71 | 52.1 | 60.0 | 25 | 64 |
| | | | 49.9 | 56.8 | 27 | 61.5 |
| | 22 | 0.75 | 52.9 | 62.9 | 21 | 68 |
| | | | 52.3 | 61.6 | OG* | 67 |
| | 23 | 1.03 | 86.1 | 92.1 | 10.5 | 83.5 |
| | | | 90.4 | 94.5 | 9 | 85 |
| | | | 61.4 | 69.5 | 17 | 69.5 |
| | | | 64.2 | 71.5 | 14 | 71.5 |
| | 24 | 1.09 | 63.2 | 71.9 | 15.5 | 69.5 |
| | | | 63.2 | 72.0 | 14 | 75 |
| 850 F. (454 C.) 12 hr. | 18 | 0.39 | 54.0 | 59.2 | 24 | 63.5 |
| | | | 54.1 | 59.9 | 26 | 63.5 |
| | 19 | 0.40 | 53.3 | 62.2 | 21.5 | 66.5 |
| | | | 53.7 | 62.4 | 20 | 68 |
| | 20 | 0.42 | 54.4 | 60.5 | 21 | 64 |
| | | | 54.4 | 60.0 | 21.5 | 63.5 |
| | 21 | 0.71 | 51.9 | 59.5 | 22 | 63.5 |
| | | | 48.7 | 55.0 | 19.5 | 65 |
| | 22 | 0.75 | 57.2 | 66.9 | 14 | 75 |
| | | | 61.3 | 70.3 | 14 | 74 |
| | 23 | 1.03 | 83.6 | 90.5 | 12 | 83.5 |
| | | | 87.2 | 91.1 | 12 | 83.5 |
| | 24 | 1.09 | 83.7 | 89.9 | 6 | 94 |
| | | | 80.6 | 85.9 | 7 | 80 |
| 925 F. (495 C.) 12 hr. | 18 | 0.39 | 50.8 | 57.0 | 21 | 64 |
| | | | 49.8 | 56.6 | 23 | 65 |
| | 19 | 0.40 | 63.4 | 71.9 | 14 | 72 |
| | | | 65.4 | 73.9 | 16 | 74 |
| | 20 | 0.42 | 54.6 | 60.3 | 24 | 61.5 |
| | | | 54.6 | 60.3 | 22 | 59 |
| | 21 | 0.71 | 56.7 | 64.1 | 15 | 62 |
| | | | 57.2 | 66.5 | OG* | 65 |
| | 22 | 0.75 | 92.4 | 96.1 | OG* | 91 |
| | | | 94.0 | 100.1 | 10 | 91 |
| | 23 | 1.03 | 86.1 | 92.1 | 10.5 | 84 |
| | | | 90.4 | 94.5 | 9 | 85 |
| | 24 | 1.09 | 104.3 | 104.3 | 5 | 91 |
| | | | 102.8 | 102.8 | 8.5 | 93 |

*Specimen broke out of gage length

We claim:

1. A method of producing hot-dip aluminum or aluminum alloy coated cold reduced, aluminum killed low carbon steel strip having high yield strength, which comprises providing a steel consisting essentially of up to about 0.1% carbon, at least about 0.015% acid soluble aluminum, manganese at least 10 times the sulfur content, up to about 1.2% copper, and balance essentially iron, hot rolling said steel, coiling the hot rolled steel at a temperature less than 1200° F. (649° C.), cold rolling to strip thickness, pretreating by heating said cold rolled strip within the range of about 700° to about 950° F. (about 370° to about 510° C.) for a time sufficient to precipitate aluminum nitride in an amount sufficient to elevate the recrystallization temperature, continuously annealing the pretreated strip at a temperature of about 1225° to about 1350° F. (about 665° to about 735° C.) in a hydrogen-containing atmosphere effective in reducing residual oxide, bringing the strip approximately to the temperature of a bath of molten aluminum or aluminum alloy, passing said strip through said bath, removing excess molten aluminum or aluminum alloy from said strip, and solidifying the aluminum or aluminum alloy remaining thereon.

2. The method of claim 1, wherein said steel consists essentially of up to about 0.1% carbon, at least about 0.015% acid soluble aluminum, about 0.75% to 1.2% manganese, residual sulfur and phosphorus, at least 0.002% nitrogen, and balance essentially iron.

3. The method of claim 1, wherein said steel consists essentially of up to about 0.1% carbon, at least about 0.015% acid soluble aluminum, about 0.8% to about 1.2% copper, residual sulfur and phosphorus, at least 0.002% nitrogen, and balance essentially iron.

4. The method of claim 1, wherein said carbon is less than about 0.05%, and said acid soluble aluminum ranges from about 0.05% to about 0.08%.

5. The method of claim 1, wherein said continuously annealed strip has a yield strength of at least 80 ksi.

6. The method of claim 1, wherein said pretreating comprises heating at a temperature within the range of about 750° to about 875° F. (about 400° C. to about 470° C.).

7. The method of claim 1, wherein said hot rolled steel is coiled at a temperature of about 1000° to about 1050° F. (about 535° C. to about 565° C.).

8. The method of claim 1, wherein said continuous anneal is conducted at a temperature of about 1225° to about 1300° F. (about 663° C. to about 705° C.).

9. Hot-dip aluminum coated, cold reduced, unrecrystallized low carbon steel strip having high yield strength, said steel consisting essentially of up to 0.1% carbon, at least about 0.015% acid soluble aluminum, manganese at least about 10 times the sulfur content, up to about 1.2% copper, and balance essentially iron.

10. Hot-dip aluminum coated strip as claimed in claim 9, wherein said steel contains about 0.8 to about 1.2% copper or about 0.75% to 1.2% manganese, residual sulfur and phosphorus, and at least 0.002% nitrogen.

11. Hot-dip aluminum coated, cold reduced, low carbon steel strip as claimed in claim 9, having a yield strength of at least 80 ksi.

* * * * *